US007621609B2

(12) United States Patent
Iriguchi

(10) Patent No.: US 7,621,609 B2
(45) Date of Patent: Nov. 24, 2009

(54) INK EJECTION METHOD AND INKJET EJECTION DEVICE

(75) Inventor: Akira Iriguchi, Ichinomiya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 12/148,811

(22) Filed: Apr. 23, 2008

(65) Prior Publication Data

US 2008/0198192 A1 Aug. 21, 2008

Related U.S. Application Data

(62) Division of application No. 11/087,121, filed on Mar. 22, 2005, now abandoned.

(30) Foreign Application Priority Data

Mar. 29, 2004 (JP) ..... 2004-094631

(51) Int. Cl.
*B41J 29/38* (2006.01)

(52) U.S. Cl. ..... 347/10

(58) Field of Classification Search ..... 347/9–14
See application file for complete search history.

(56) References Cited

U.S. PATENT DOCUMENTS 6,663,208 B2 12/2003 Suzuki et al.
6,685,293 B2 * 2/2004 Junhua ..... 347/14

FOREIGN PATENT DOCUMENTS

| | | |
|---|---|---|
| JP | 11-078000 | 3/1999 |
| JP | 2002-160362 | 6/2002 |
| JP | 2002-234198 | 8/2002 |

* cited by examiner

*Primary Examiner*—Stephen D Meier
*Assistant Examiner*—Geoffrey Mruk
(74) *Attorney, Agent, or Firm*—Reed Smith LLP

(57) ABSTRACT

An ink ejecting device includes a plurality of nozzles, a plurality of pressure chambers respectively corresponding to the plurality of nozzles, an actuator capable of changing capacity of each of the plurality of pressure chambers. A first drive pulse signal is selected in accordance with dot information indicating dots to be formed on a recording medium successively. When the dot information for the current ejection cycle and the dot information for the succeeding ejection cycle indicate a first condition where ejection of a large amount of ink drop and no ejection of an ink drop, respectively, driving pulse signals for the current ejection cycle and the succeeding ejection cycle are selected, respectively. The driving pulse signals for the current ejection cycle and the succeeding ejection cycle are then output in the current ejection cycle and within the succeeding ejection cycle, respectively.

6 Claims, 13 Drawing Sheets

| DOT INFORMATION EACH COLUMN | | | SELECTED WAVEFORM | DESIG. SIGNAL |
|---|---|---|---|---|
| n − 1 | n | n+1 | | |
| NONE | NONE | – | WAVEFORM #0 | 0 |
| – | SMALL DROPLET | – | WAVEFORM #1 | 1 |
| – | MIDDLE DROPLET | – | WAVEFORM #2 | 2 |
| – | SMALL DROPLET FOR DRY | – | WAVEFORM #3 | 3 |
| – | LARGE DROPLET | | WAVEFORM #4 | 4 |
| – | LARGE END DROPLET (WAVEFORM #5) | NONE (WAVEFORM #6) | WAVEFORM #5+ WAVEFORM #6 | 5 |
| LARGE END DROPLET (WAVEFORM #5) | NONE (WAVEFORM #6) | – | WAVEFORM #5+ WAVEFORM #6 | 5 |

FIG. 9

| DOT INFORMATION EACH COLUMN | | | SELECTED WAVEFORM | DESIG. SIGNAL |
|---|---|---|---|---|
| n − 1 | n | n+1 | | |
| NONE | NONE | – | WAVEFORM #0 | 0 |
| – | SMALL DROPLET | – | WAVEFORM #1 | 1 |
| – | MIDDLE DROPLET | – | WAVEFORM #2 | 2 |
| – | SMALL DROPLET FOR DRY | – | WAVEFORM #3 | 3 |
| – | LARGE DROPLET | | WAVEFORM #4 | 4 |
| – | LARGE END DROPLET (WAVEFORM #5) | NONE (WAVEFORM #6) | WAVEFORM #5+ WAVEFORM #6 | 5 |
| LARGE END DROPLET (WAVEFORM #5) | NONE (WAVEFORM #6) | – | WAVEFORM #5+ WAVEFORM #6 | 5 |

INK EJECTION METHOD AND INKJET EJECTION DEVICE

RELATED APPLICATIONS

This is a divisional patent application of U.S. application Ser. No. 11/087,121 filed Mar. 22, 2005 now abandoned which claims priority from Japanese Patent Application No. 2004-094631 filed on Mar. 29, 2004, the entire subject matters of the applications are incorporated herein by reference thereto.

INCORPORATION BY REFERENCE

This application claims priority from Japanese Patent Application No. 2004-094631, filed on Mar. 29, 2004, the entire subject matters of the applications are incorporated herein by reference thereto.

BACKGROUND OF THE INVENTION

The present invention relates to an ink ejection method and an ink ejection device employing the ink ejection method.

In the inkjet printer, an extra ink droplet called a satellite droplet may be generated in addition to a main ink droplet. When a plurality of droplets are continuously ejected to form a dot, and thereafter, if the pressure wave vibration in a pressure chamber is not reduced sufficiently, such a residual pressure wave vibration will cause an extra ink droplet to be ejected in the form of a satellite. Further, although the satellite ink droplet is not generated, formation of a succeeding ink dot may become unstable due to the variation of the pressure wave in the pressure chamber. Conventionally, in order to deal with such a phenomenon, a cancel pulse is inserted in the drive waveform to suppress the vibration in the pressure chamber.

U.S. Pat. No. 6,663,208 B2 discloses a controller for inkjet apparatus, which controller controls outputting of drive waveform to suppress the vibration in the pressure chamber, the teachings of which being incorporated herein by reference.

FIG. 13 shows a timing chart that is similar to FIG. 7 of the U.S. Pat. No. 6,663,208 B2. The timing chart shows four waveforms: a drive waveform #0; a drive waveform #1, a drive waveform #2, a drive waveform #3, and a long waveform selection signal. The sections indicated by A-D are print cycles, respectively. Drive waveform #1 is used to output a plurality of pulses within a print cycle to form a single dot. Drive waveforms #2 and #3 are used to output a plurality of pulses over two adjacent print cycles. Drive waveforms #2 and #3 have a plurality of ejection pulses that cause continuous ejection of a plurality of ink droplets, and a cancel pulse at the end that suppresses the pressure wave vibration in the cavity. The drive waveforms #2 and #3 have the same pulse string but are shifted from each other by one print cycle, which is defined by a strobe signal.

SUMMARY OF THE INVENTION

According to the configuration disclose in above U.S. Pat. No. 6,663,208 B2, in order to drive the inkjet head, a relatively complicated wave generating circuit is required. That is, according to the configuration, a long waveform that extends over two ejection cycles is employed to suppress the satellite. Since the long waveform is used, the number of pulse signals contained in one drive waveform (i.e., the long waveform) is relatively large. Therefore, the pulse generating circuit for generating a signal having such a waveform is complicated. Further, although the drive waveforms #2 and #3 have the same but shifted waveforms, the drive waveforms #2 and #3 should be memorized separately. Therefore, a relatively large storage capacity is required. In view of the above, according to the conventional configuration, a manufacturing cost of the inkjet head may increase.

The present invention is advantageous in that an inkjet head which is capable of suppress occurrence of satellite droplets and manufactured at a lower cost in comparison with a conventional inkjet head configured to suppress the satellite droplet.

According to an aspect of the invention, there is provided a method of ejecting ink droplets for an ink ejecting device, the ink ejecting device including a plurality of nozzles, a plurality of pressure chambers respectively corresponding to the plurality of nozzles, an actuator capable of changing capacity of each of the plurality of pressure chambers, a first drive pulse signal being applied to the actuator at every predetermined ejection cycle, the first drive pulse signal being selected in accordance with dot information indicating dots to be formed on a recording medium successively. When the dot information for the current ejection cycle and the dot information for the succeeding ejection cycle indicate a first condition where ejection of a large amount of ink drop and no ejection of an ink drop, respectively, driving pulse signals for the current ejection cycle and the succeeding ejection cycle are selected, respectively, the driving pulse signals for the current ejection cycle and the succeeding ejection cycle being output in the current ejection cycle and within the succeeding ejection cycle, respectively.

According to another aspect of the invention, there is provided an ink ejection device, which includes a plurality of nozzles for ejecting ink droplets, a plurality of pressure chambers respectively corresponding to the plurality of nozzles, an actuators capable of changing capacity of each of the plurality of pressure chambers, a controlling device that applies a drive pulse signal to the actuator at every predetermined ejection cycle to change the capacity of each pressure chamber to make each nozzle eject an ink droplet, the drive pulse signal being selected in accordance with dot information indicating dots to be formed on a recording medium successively in a direction of a relative movement of the plurality of nozzles with respect to the recording medium. With this configuration, the controlling device may include a pulse waveform generating system that generates a plurality of drive pulse signals each of which lasts within the predetermined ejection cycle, a signal selecting system that selects one of the plurality of drive pulse signals for each of two successive ejection cycles in accordance with the dot information corresponding to the two successive ejection cycles, and a signal output system that outputs the selected drive pulse signals. When the dot information for the current ejection cycle and the dot information for the succeeding ejection cycle indicate a first condition where ejection of a large amount of ink drop and no ejection of an ink drop, respectively, the signal selecting system selects two kinds of driving pulse signals for the current ejection cycle and the succeeding ejection cycle are selected, respectively, such that the selected drive pulse signals are different from drive pulse signals for a second condition in which the dot information for the current ejection cycle indicates ejection of a large ejection amount of an ink drop and the dot information for the succeeding ejection period indicates ejection of an ink drop. Further, the signal output system outputs the two kinds of driving pulse signals for the current ejection cycle and the succeeding ejection cycle within the current ejection cycle and in the succeeding ejection cycle, respectively.

Optionally, the signal outputting system may output the two types of drive pulse signals selected, in the first condition, for the current ejection cycle and the succeeding ejection cycle are output continuously over the current ejection cycle and the succeeding ejection cycle.

According to a further aspect of the invention, there is provided a computer program product having computer accessible instructions that is executed by a controlling device of an ink ejection device which includes a plurality of nozzles for ejecting ink droplets, a plurality of pressure chambers respectively corresponding to the plurality of nozzles, an actuator capable of changing capacity of each of the plurality of pressure chambers, and the controlling device that applies a drive pulse signal to the actuator at every predetermined ejection cycle to change the capacity of each pressure chamber to make each nozzle eject an ink droplet, the drive pulse signal being selected in accordance with dot information indicating dots to be formed on a recording medium successively in a direction of a relative movement of the plurality of nozzles with respect to the recording medium. The controlling device includes a pulse waveform generating system that generates a plurality of drive pulse signals each of which lasts within the predetermined ejection cycle, a signal selecting system that selects one of the plurality of drive pulse signals for each of two successive ejection cycles in accordance with the dot information corresponding to the two successive ejection cycles, and a signal output system that outputs the selected drive pulse signals. Further, when the dot information for the current ejection cycle and the dot information for the succeeding ejection cycle indicate a first condition where ejection of a large amount of ink drop and no ejection of an ink drop, respectively, the signal selecting system selects two kinds of driving pulse signals for the current ejection cycle and the succeeding ejection cycle are selected, respectively, such that the selected drive pulse signals are different from drive pulse signals for a second condition in which the dot information for the current ejection cycle indicates ejection of a large ejection amount of an ink drop and the dot information for the succeeding ejection period indicates ejection of an ink drop. Furthermore, the signal output system outputs the two kinds of driving pulse signals for the current ejection cycle and the succeeding ejection cycle within the current ejection cycle and in the succeeding ejection cycle, respectively.

Optionally, the signal outputting system may output the two types of drive pulse signals selected, in the first condition, for the current ejection cycle and the succeeding ejection cycle may be output continuously over the current ejection cycle and the succeeding ejection cycle.

Optionally, the drive pulse signals respectively selected, in the first condition, for the current ejection period and the succeeding ejection period may be different from the drive pulse signals respectively selected, in a second condition, for the current ejection period and the succeeding ejection period. It should be noted that the second condition is a condition where the dot information for the current ejection cycle indicates ejection of a large ejection amount of an ink drop and the dot information for the succeeding ejection period indicates ejection of an ink drop. Further, the drive pulse signals selected, in the first condition, for the current ejection cycle and the succeeding ejection cycle may be output continuously over the current ejection cycle and the succeeding ejection cycle.

Still optionally, the drive pulse signal selected, in the first condition, for the current ejection period may be selected such that the number of ejection pulses included in the drive signal is less than the number of drive pulses included in the drive pulse signal selected, in the second condition, for the current ejection period, and the drive pulse signal selected, in the first condition, for the succeeding ejection cycle may include the ejection pulse.

Further optionally, the drive pulse signal selected, in the first condition, for the succeeding ejection cycle may be the same as the drive pulse signal corresponding to the dot information indicating a small ink ejection amount.

Furthermore, the drive pulse signal selected, in the first condition, for the succeeding ink ejection cycle may include a cancel pulse that reduces a change of pressure of the corresponding pressure chamber.

BRIEF DESCRIPTION OF THE ACCOMPANYING DRAWINGS

FIG. 1 schematically shows a plan view of an inkjet printer to which the present invention is applicable;

FIG. 9 shows a table indicating a relationship between dot information for each column and a drive waveform to be selected;

DETAILED DESCRIPTION OF THE EMBODIMENT

Referring now to the accompanying drawings, an inkjet printer according to an exemplary embodiment of the invention will be described in detail.

Figure 1:
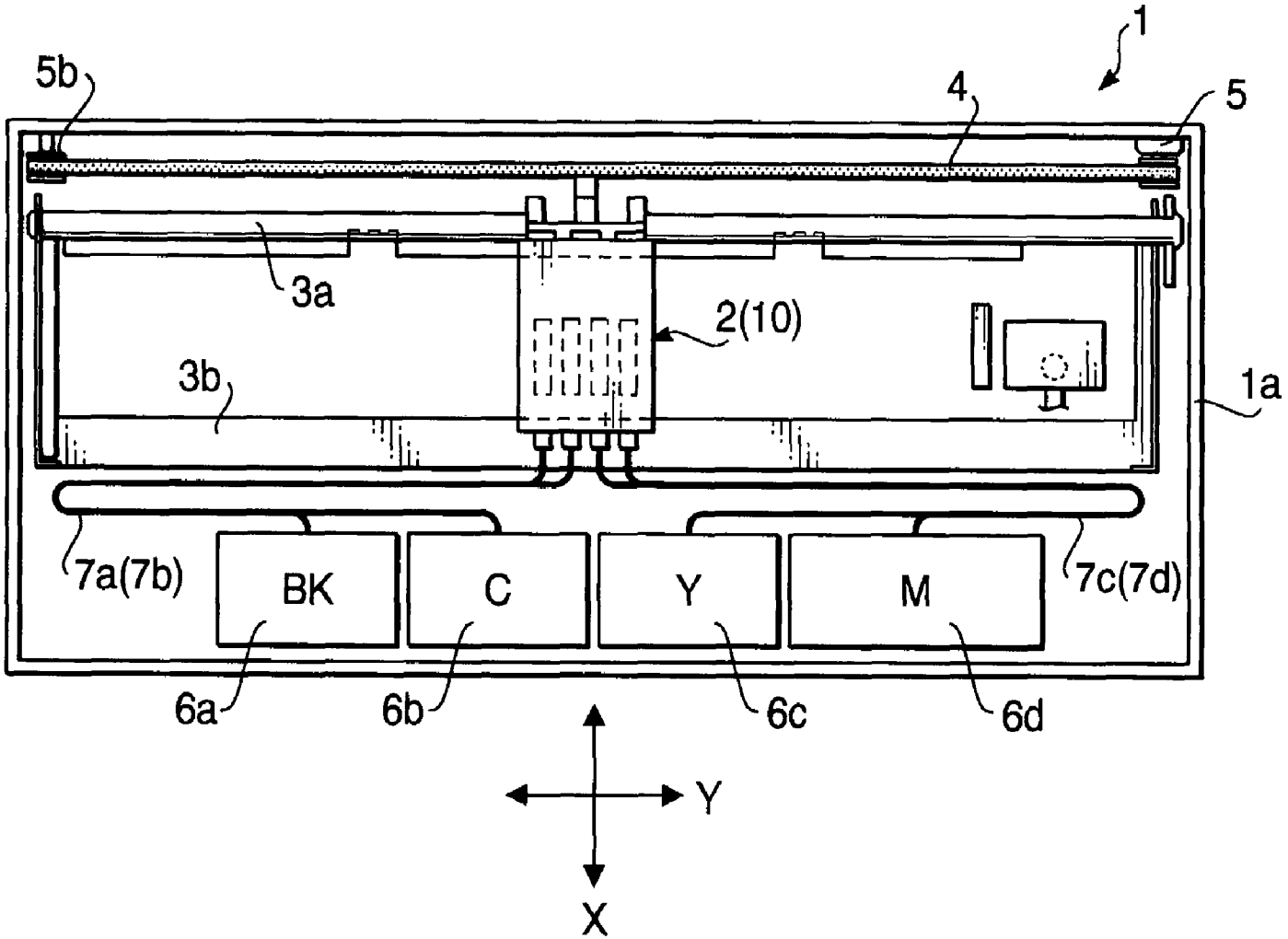

FIG. 1 schematically shows a plan view of an inkjet printer 1 according to the embodiment of the invention. The inkjet printer 1 is provided with a carriage 2 mounting a recording head 10, which is an inkjet head, on its lower surface. The carriage 10 is slidably supported by a pair guide rails 3*a* and 3*b* which are parallelly arranged inside a casing 1*a* of the inkjet printer 1. A timing belt 4 is provided in parallel with the guide rails 3*a* and 3*b*. The timing belt 4 is an endless belt wound around a driving shaft of a carriage motor 5 provided on a right-hand side of the casing 1*a* in FIG. 1, and a pulley 5*b* provided on a left-hand side of the casing 1*a* in FIG. 1. The carriage 2 is connected to the timing belt 4. As the carriage motor 5 is driven to rotate, the timing belt 4 moves in the direction parallel with the guide rails 3*a* and 3*b* (i.e., Y direction in FIG. 1: which will also be referred to as a main scanning direction). Depending on the rotation direction of the carriage motor 5, the carriage 2 is moved in either the rightward or leftward direction in FIG. 1. Recording sheets (not shown) are fed in a direction perpendicular to the Y direction.

The inkjet printer 1 is a full-color printer, and for the full-color recording, four ink cartridges 6*a* through 6*d* respectively containing black (BK) ink, cyan (C) ink, magenta (M) ink and yellow (Y) ink are mounted along the Y direction on the casing 1*a* of the inkjet printer 1. The ink cartridges 6*a* through 6*d* are connected to the recording head 10 with ink supply tubes 7*a* through 7*d*, through which the BK, C, M and Y inks are supplied to the recording head 10, respectively. It should be noted that, in a modification, it may be possible to mount the ink cartridges 6*a* through 6*d* on the carriage 2.

Figure 2:
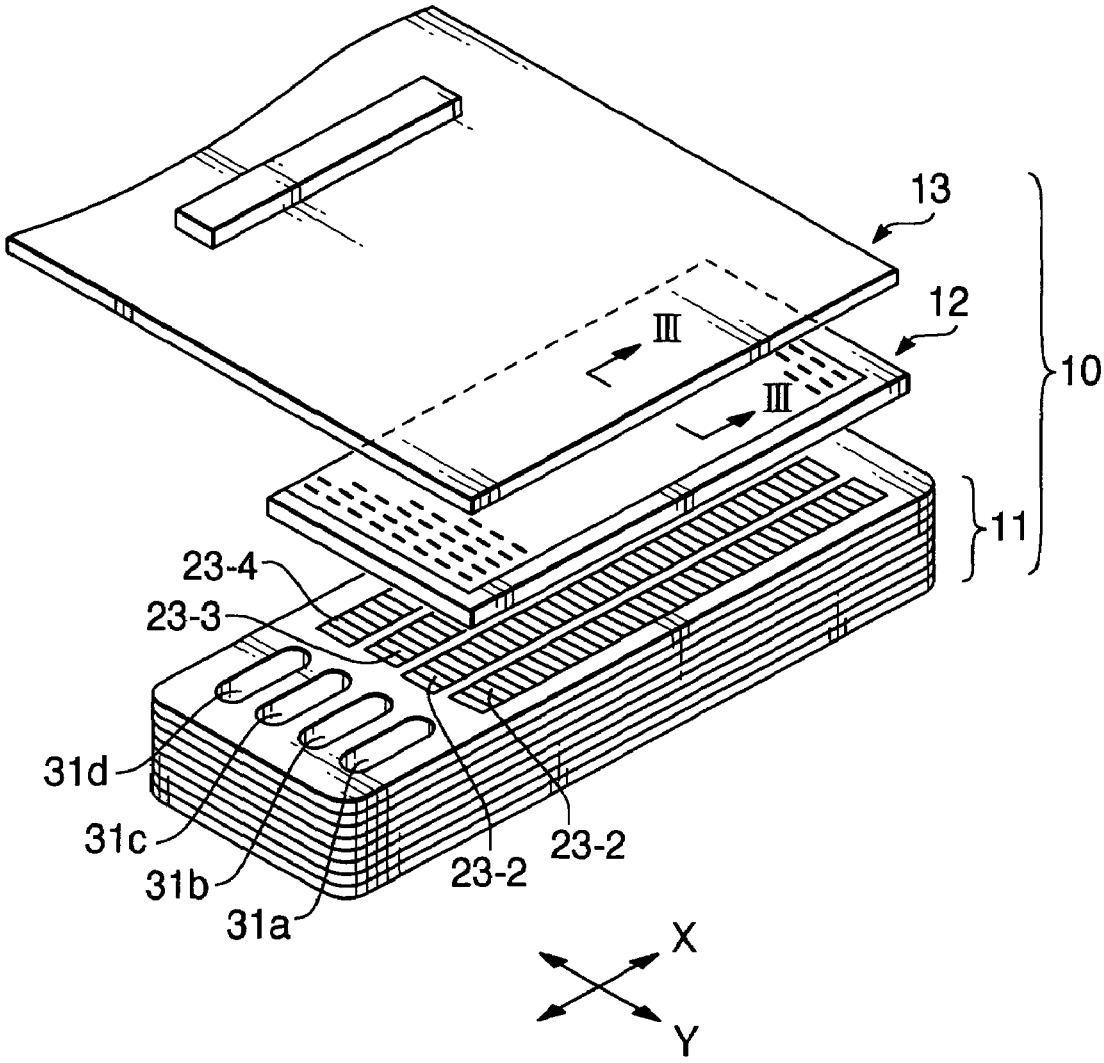
FIG. 2 is a exploded perspective view of a recording head according to an embodiment of the invention.
Figure 3:
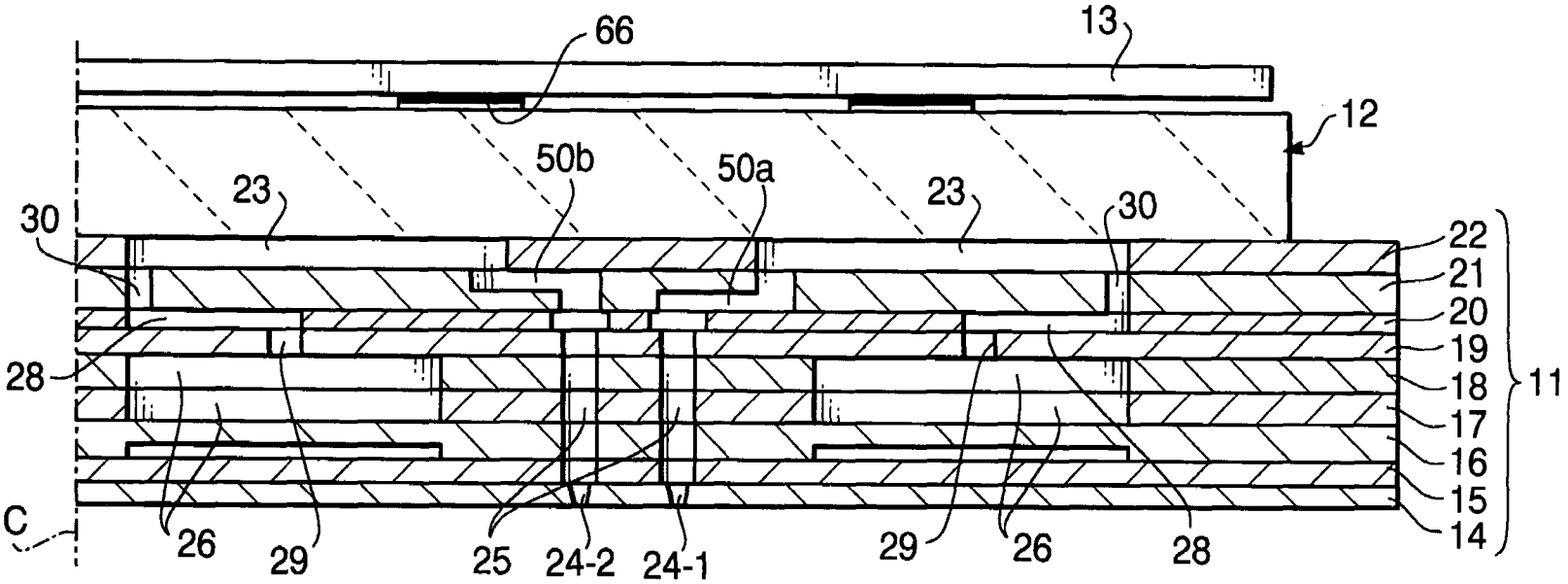
FIG. 3 is an enlarged cross sectional view of the cavity unit taken along line III-III of FIG. 2.
Figure 4:
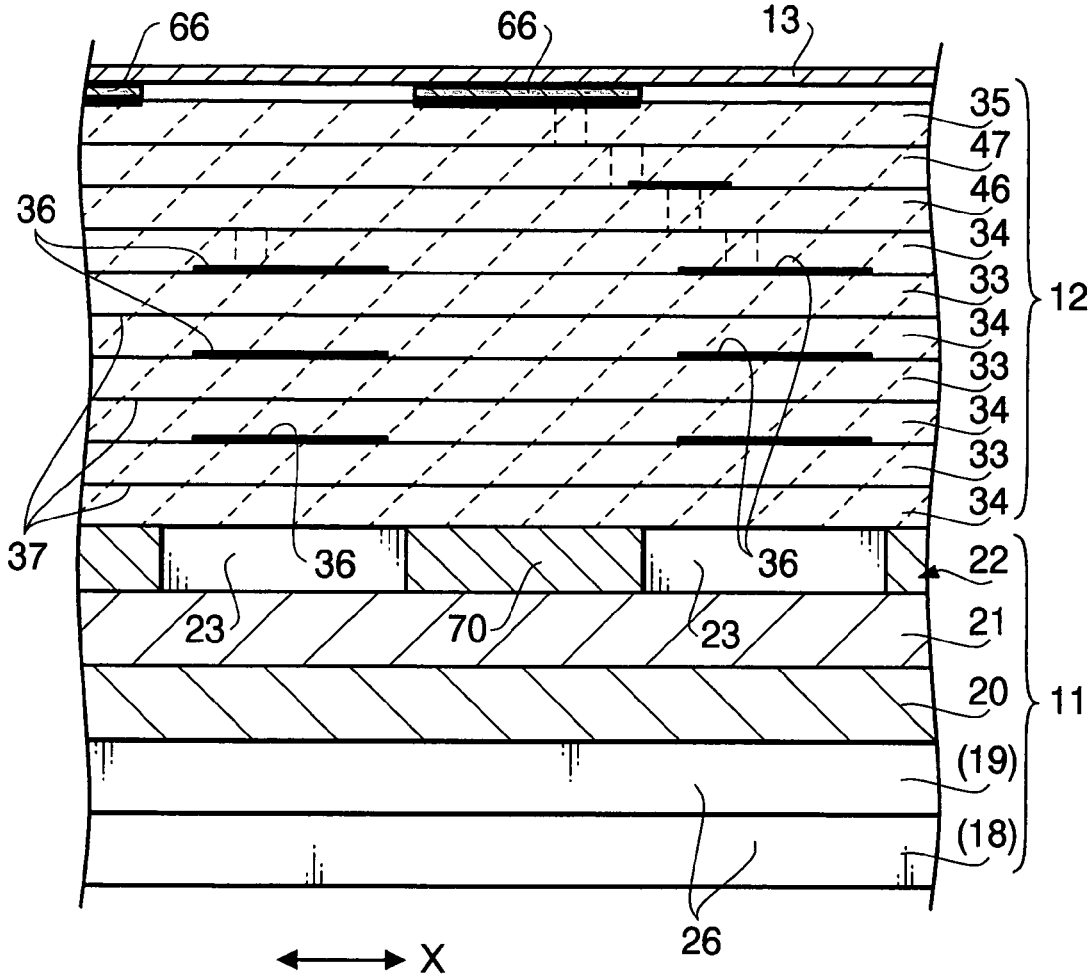
FIG. 4 is a partially enlarged view of a piezoelectric actuator employed in the cavity unit shown in FIG. 2.

FIG. 2 is an exploded perspective view of the recording head 10 showing a cavity unit 11 and a piezoelectric actuator 12. FIG. 3 is an enlarged cross sectional view of the cavity unit 11 taken along line III-III of FIG. 2. FIG. 4 is a partially enlarged view of an active portion of the piezoelectric actuator 12.

As shown in FIGS. 2 through 4, the recording head 10 has the cavity unit 11 which is made of a plurality of stacked metal plates, and the piezoelectric actuator 12, which is a plate stacked type piezoelectric actuator and is cemented on the cavity unit 11. Above the piezoelectric actuator 12, a flat cable 13 is connected by soldering. Through the flat cable 13, the recording head 10 is connected with an external device. Image data and head drive signals are transmitted through the flat cable 13.

The structure of the cavity unit 11 will be described in detail. As shown in FIGS. 2-4, the cavity unit 11 includes a plurality of stacked layers (plates). Specifically, the cavity unit 11 includes, from the bottom to top, a nozzle plate 14, a cover plate 15, a dumper plate 16, a pair of manifold plates 17 and 18, three spacer plates 19, 20 and 21, and base plate 22 in which pressure chambers 23 are formed. The nine thin plates are stacked and adhered with each other using adhesive agent. In the embodiment, each plate, except for the nozzle plate 14 which is made of synthetic resin, is made of 42% nickel alloy steel plate having a thickness of 50 μm-150 μm.

Figure 12:
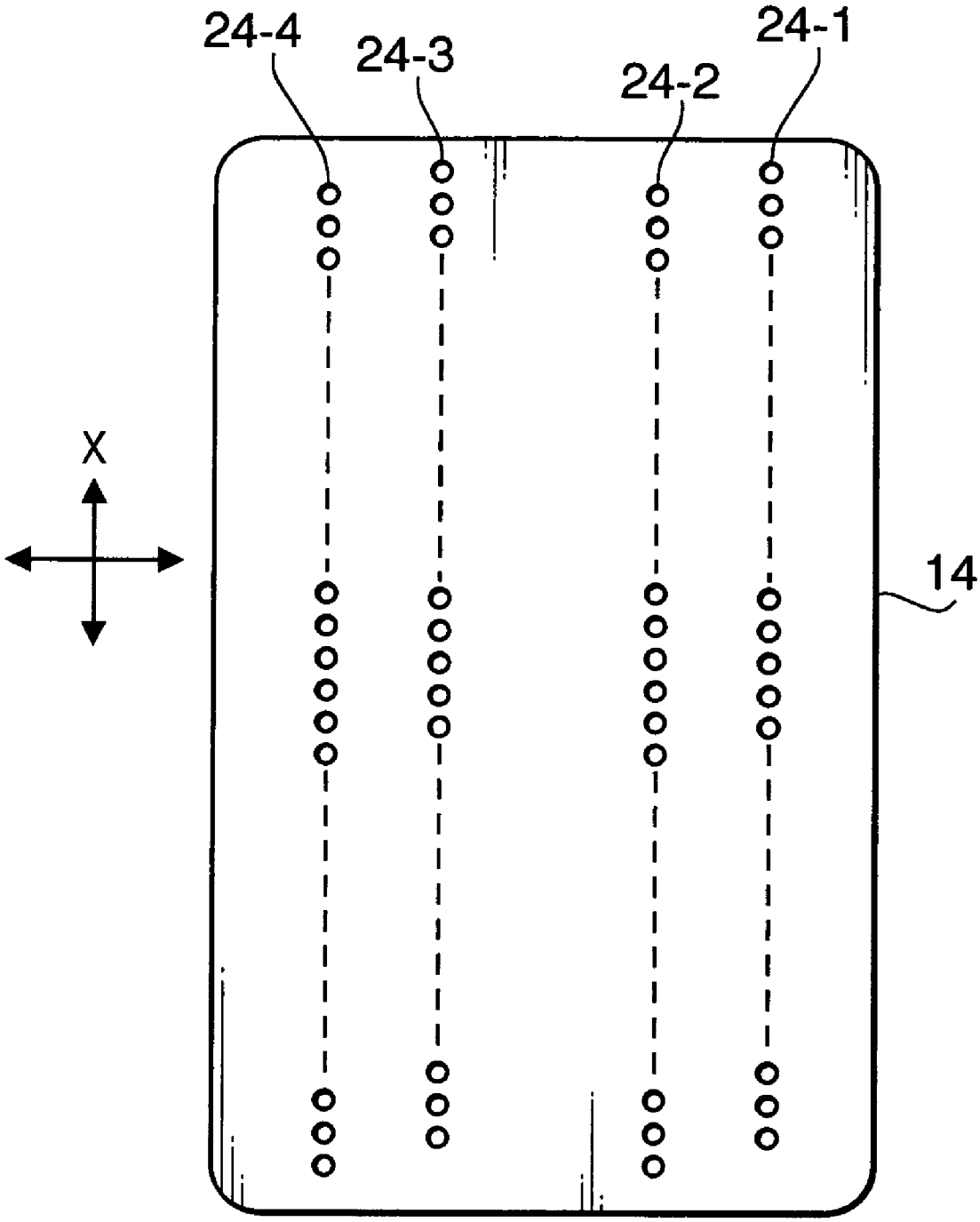
FIG. 12 is a plan view of a nozzle plate provided with a plurality of nozzles.
Figure 13:
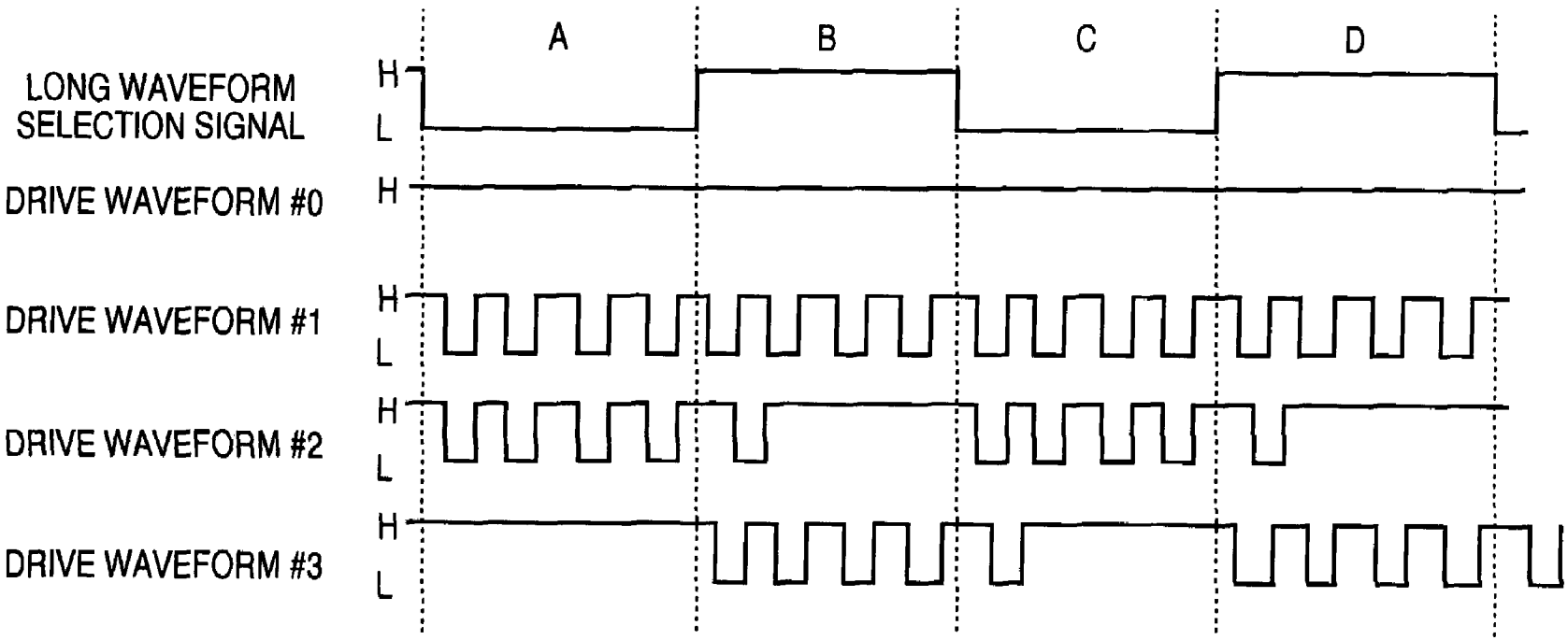
FIG.13 PRIOR ART
FIG. 13 is a timing chart illustrating drive waveforms according to a conventional art.

The nozzle plate 14 is formed with a plurality of ink ejection nozzles 24. Each nozzle 24 has a minute diameter (25 μm in this embodiment). Hereinafter, a direction parallel to a longer side of the cavity unit 11 will be referred to as an X direction or first direction, and a direction parallel to a shorter side of the cavity unit 11 will be referred to as a Y direction (see FIGS. 1-4) or a second direction. The plurality of nozzles 24 are arranged such that four arrays of nozzles, each array extending in the first direction, are aligned in the second direction. FIG. 12 is a plan view of the nozzle plate 14. As shown in FIG. 12, the two adjoining arrays (24-1 and 24-2; and 24-3 and 24-4) of nozzles 24 are slightly shifted in the first direction (X direction) so that the nozzles 24 of the adjoining two arrays exhibit a hound's-tooth (zigzag) arrangement pattern.

The position of the first and third arrays (24-1 and 24-3) and the position of the second and fourth arrays (24-2 and 24-4) are slightly shifted in X direction so that the plurality of nozzles 24 are arranged in a zigzag manner.

FIG. 3 shows a right-hand side half with respect to a central line C of a cross section of the cavity unit 11 cut in the Y direction (along line III-III in FIG. 2). The first nozzle array 24-1 on the right-hand side and the second nozzle array 24-2 on the center line side are aligned along two parallel reference lines extending in the X direction (see FIG. 12). Similarly, a third nozzle array 24-3 and a fourth nozzle array 24-4 are aligned along two parallel reference lines extending in the X direction. The nozzles 24 in each array are arranged at a minute pitch P. The first nozzle array 24-1 and the second nozzle array 24-2 are arranged in parallel with and spaced from each other. Similarly, the third nozzle array 24-3 and the fourth nozzle array 24-4 are arranged parallel with and spaced form each other. According to the embodiment, the length of each of the first through fourth nozzle arrays is 1 inch, and the number of nozzles in each nozzle array is 75. Therefore, the density of the nozzle arrangement is 75 dpi (dots per inch) in this example.

In FIG. 2, 23-1 denotes a first pressure chamber array which includes a plurality of pressure chambers 23 formed in a base plate 22 (see FIG. 3), which is the uppermost layer of the cavity unit 11. The pressure chamber array 23-1 is formed corresponding to the first nozzle array 24-1 (see FIG. 12). Similarly, a second pressure chamber array 23-2, a third pressure chamber array 23-3 and a fourth pressure chamber array 23-4 correspond to the second nozzle array 24-2, the third nozzle array 24-3 and the fourth nozzle array 24-4, respectively.

Next, the arrangement of the pressure chambers 23 in the base plate 22 will be described in detail.

In one piezoelectric actuator 12, seventy-five (75) active portions are provided to actuate the pressure chambers 23 for nozzles 24 of each nozzle array. The piezoelectric actuator 12 is configured such that common electrodes 37 and individual electrodes 36 arranged at positions corresponding to the positions of the pressure chambers 23 are alternately stacked with piezoelectric sheets therebetween, as shown in FIG. 4. By applying a voltage between the common electrode 37 and the individual electrode 36, the active portion of the piezoelectric sheet at a position corresponding to the individual electrode 36 to which the voltage is applied is distorted due to a lateral piezoelectric effect in the stacked direction.

As mentioned above, the active portions are arranged in a direction in which the nozzles 24 (or the pressure chambers 23) of each array are arranged (i.e., X direction), and also in the direction in which the nozzle arrays are arranged (i.e., Y direction) by the same number as the number of arrays of the nozzles 24. Each active portion is formed to be elongated in Y direction. The pitch of the active portions in each array is the same as the pitch of the pressure chambers 23 in the same array. As a whole, the active portions are also arranged in a zigzag manner, corresponding to the nozzles 24.

Each pressure chamber 23 is elongated in a with direction of the base plate 22 (i.e., Y direction), and formed as a through opening in the thickness direction of the base plate 22. Two adjacent pressure chambers 22 and 22 are insulated by a wall 70. An inlet end of each pressure chamber 23 communicates with the manifold chamber 26 (see FIG. 3) via a second ink passage 30, a throttle portion 28 and a first ink passage 29 formed on spacer plates 19, 20 and 21, respectively.

An outlet end of each pressure chamber 23 communicates with a nozzle 24 via a passage 25 which is formed through the spacer plates 19, 20 and 21 and manifold plates 17 and 18, dumper plate 16 and cove plate 15, which are located between the base plate and nozzle plate 14. The passage 25 includes a U-shaped concave passage 50 on at least one of the plates 15 through 21. The U-shape concave (groove) passage 50 has a bottom surface substantially parallel with a planar surface (i.e., a front or rear surface) of at least one of the plates 15 through 21 on which the passage 50 is formed. With this configuration, two through passages 25 and 25 are formed between two manifold chambers 26 and 26 corresponding to the two adjoining nozzle arrays (see FIG. 3).

The piezoelectric actuator 12 includes, as shown in FIG. 4, a group of piezoelectric sheets having alternately stacked piezoelectric sheets 33 and 34, constrained layer having two sheets 46 and 47 provided above the group of piezoelectric sheets 33 and 34, and a top sheet 35 provided above the constrained layer. In the embodiment, the alternately layer piezoelectric sheets 33 and 34 includes seven layers of the alternately arranged piezoelectric sheets 33 and 34. Each of the sheets 46 and 47 of the constrained layer and the top sheet 35 can be a piezoelectric ceramic sheet, or another plate formed of other material which has an electrically insulating property.

On odd piezoelectric sheets 34 counted upward from the lowermost piezoelectric sheet 34, common electrodes 37 are arranged, and on the upper surfaces of even piezoelectric sheets 33, individual electrodes 36 corresponding to the pressure chambers 23 of the cavity unit 11 are arranged at positions corresponding to the locations of the pressure chambers 23. The individual electrodes 36, the common electrodes 37 and piezoelectric sheets 33 and 34 sandwiched between the individual electrodes 36 and the common electrodes 37 constitute the active portions. Each of the individual electrodes 37 as an area, in plan view, having substantially the same shape of the corresponding pressure chamber 23, and is formed to have an elongated shape extending in Y direction which is parallel with a shorter side of the piezoelectric sheet 33.

With the above configuration, by applying a predetermined high voltage between all of the individual electrodes 36 and the common electrodes 37 via the individual connection electrodes 66 and common connection electrodes of the piezoelectric actuator 12, portions of the piezoelectric sheets 33 and 34 sandwiched between the individual electrodes 36 and the common electrodes 37 are polarized. Then, via a desired individual connection electrode 66 and the common connection electrode, a driving voltage is applied between a desired individual electrode and the common electrode 37 to generate an electric field at the desired active portion in the polarized direction, the active portion extends in its layered (stacked) direction, thereby the inner capacity of the corresponding pressure chamber 23 being reduced. Then, the ink inside the pressure chamber 23 is ejected as a droplet through the corresponding nozzle 24, thereby desired printing operation being performed.

When a color printing is performed and four color inks (i.e., BK, C, Y and M inks) are used, for example, the first nozzle array 24-1 is used for ejecting the BK ink, the second nozzle array 24-2 is used for ejecting the C ink, the third nozzle array 24-3 is used for ejecting the Y ink, and the fourth nozzle array 24-4 is used for ejecting the M ink. Then, the first manifold chambers 26 formed on the manifold plate 17 (18) is filled with the BK ink, the second manifold chamber 26 is filled with the C ink, the third manifold chamber 26 is filled with the Y ink, and the fourth manifold chamber 26 is filled with the M ink.

Next, a driving device that provides various drive signals (drive waveforms) to be applied to the individual electrodes 36 and the common electrodes 37 will be described.

Figure 5:
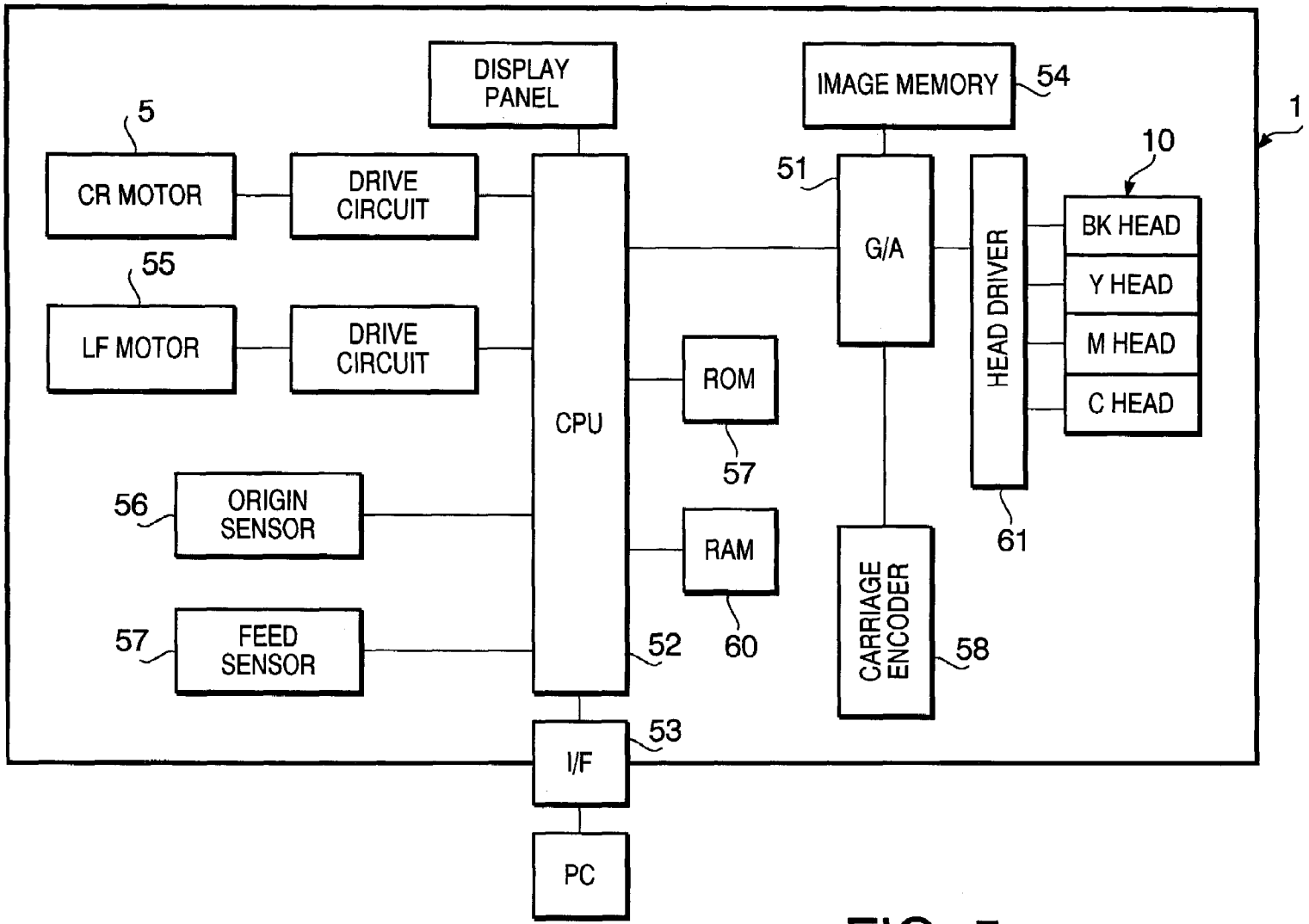
FIG. 5 is a block diagram of a configuration of the inkjet printer according to the embodiment of the invention.

Firstly, main portions of the inkjet printer 1 will be described referring to a block diagram shown in FIG. 5.

The inkjet printer 1 is provided with a Gate Array circuit G/A 51, a CPU (Central Processing Unit) 52 that controls the entire operation of the inkjet printer 1, an interface (I/F) 53 used for connecting the inkjet printer 1 with an computer system PC such as a personal computer, an image memory 54 for storing print data received from the computer system PC, a CR motor 5 for moving the carriage, an LF motor 55 for feeding the recording sheets, an origin point sensor 56 used for detecting the origin point of the carriage, a feed sensor 57 for detecting presence/absence of the recording sheets at a print position, a carriage encoder 58 detecting a position of the carriage, a ROM (Read Only Memory) 59 that stores various programs executed in the inkjet printer 1 and data used in the programs, a RAM (Random Access Memory) 60 that temporarily stores data when the various programs are executed, a head driver 61, inkjet heads for the four colors of BK, C, M and Y, and a power source (not shown).

Figure 6:
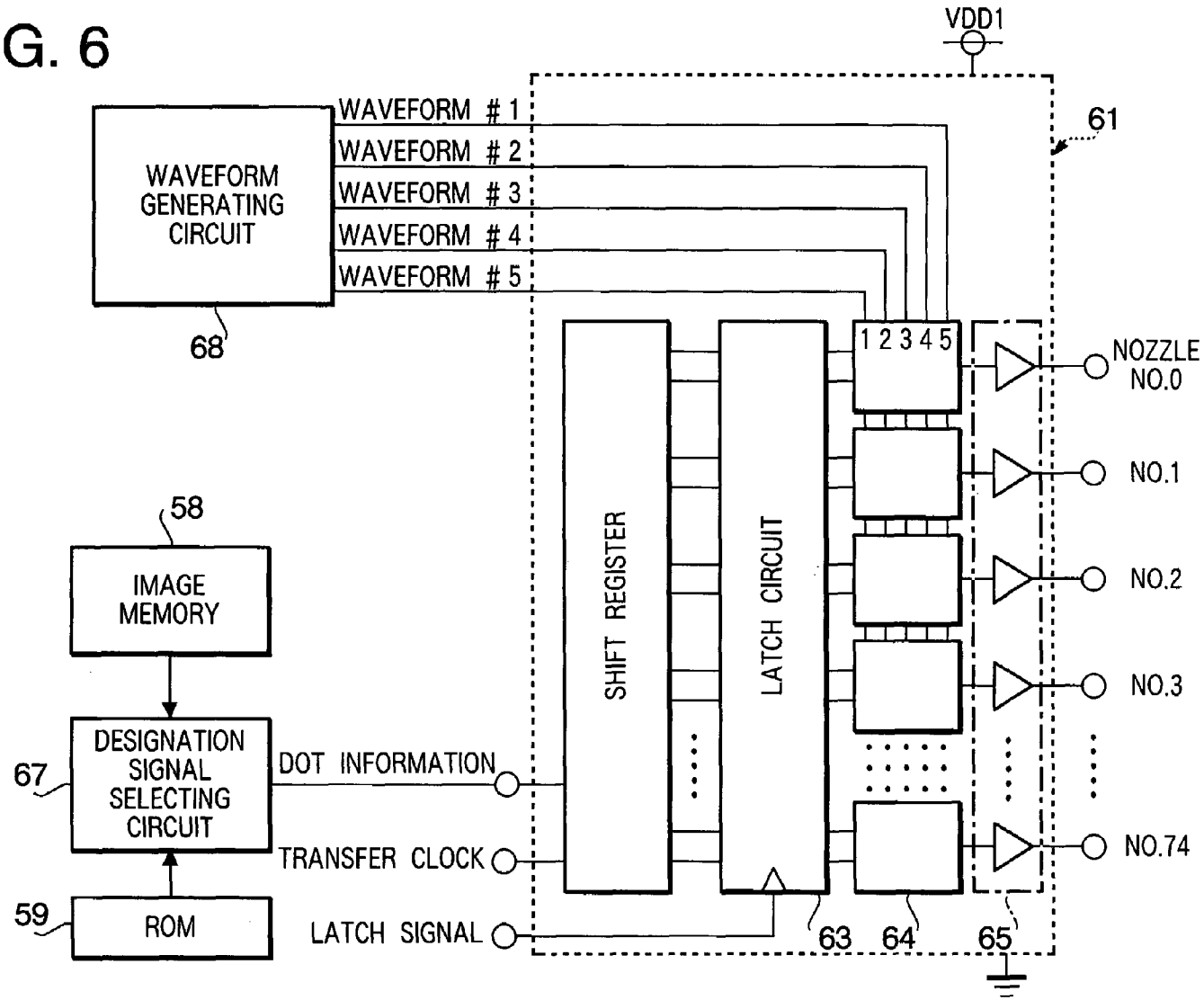
FIG. 6 is a block diagram of a driving device.

FIG. 6 is a block diagram of the head driver 61. As shown in FIG. 6, the head driver 61 includes a shift register 62, a latch circuit (a flip-flop circuit) 63, multiplexers 64, and drivers 65. Each driver 65 is connected with the common electrode corresponding to the active portions of the piezoelectric actuator 12.

A designation signal selecting circuit 67 included in the Gate array circuit (G/A) 51 retrieves the print data (i.e., dot information) stored in the image memory 54, and, based on the dot information (which includes gradation information) and data (dot information and related ejection cycles or column number data, which will be describe in detail later) in the ROM 59, a designating signal for designating a kind of waveform signal is generated, which is output as serial data. According to the embodiment, one of predetermined seven drive waveforms is selected. The designating signal serially output is input to the shift register 62, and converted into parallel data corresponding to the number of the nozzles of one inkjet head.

The designating signal converted into the parallel data is latched in the latch circuit 63, and is output to the multiplexers 64 synchronously with the strobe signal. To the multiplexers 64, five kinds of drive waveforms are input from the waveform generating circuit 68. Further, a fixed voltage VDD1 is also applied. Thus, six kinds of waveforms are input to the head driver 61.

Figure 8:
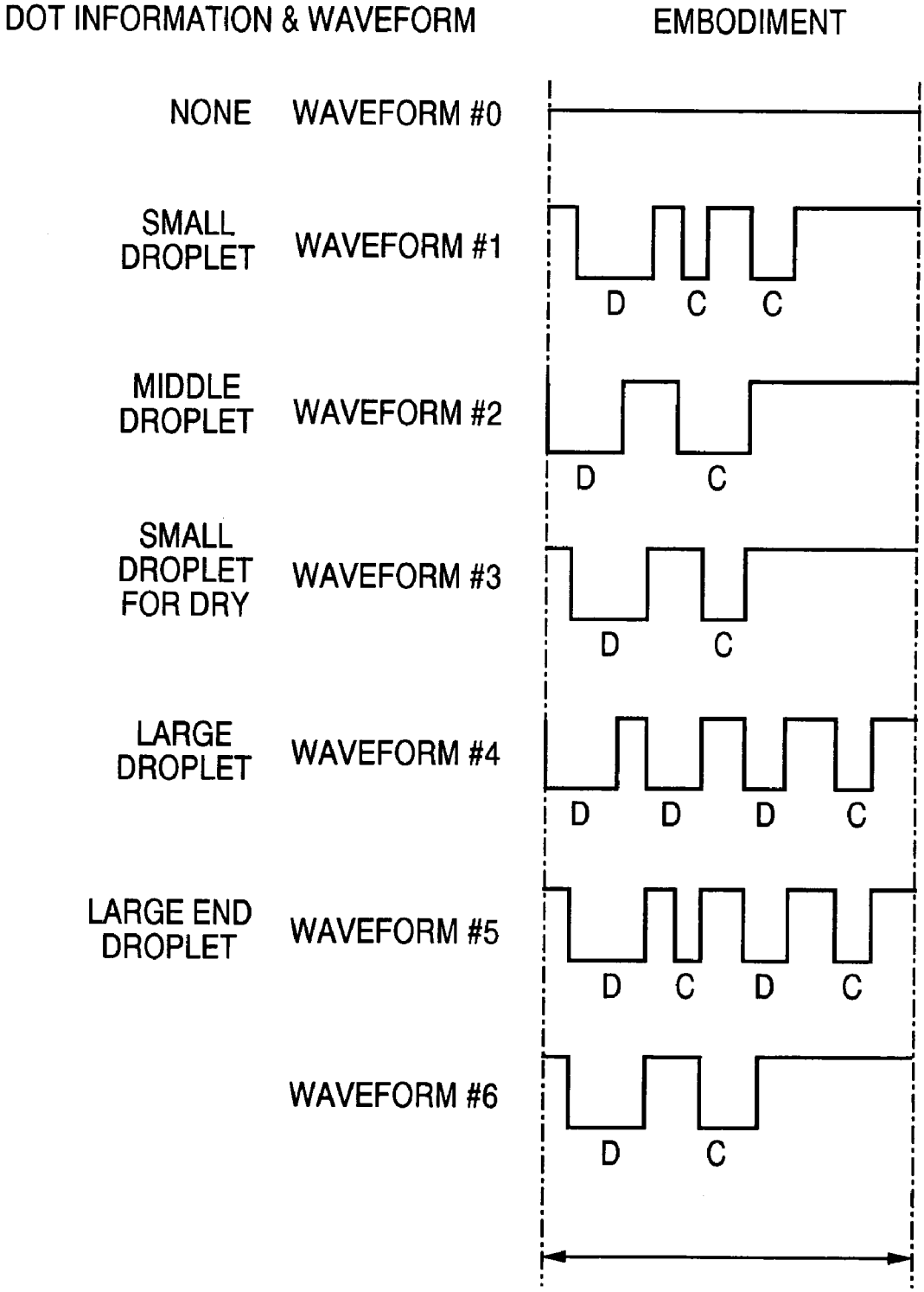
FIG. 8 shows a timing chart illustrating drive waveforms according to the embodiment of the invention.

FIG. 8 shows a timing chart illustrating drive waveforms. Each of the waveforms 0 through 6 are configured such that a plurality of pulses are output within one ejection cycle To and an ink dot is (or is not) formed on one column. Therefore, a width and interval of each pulse is determined in advance in accordance with the structure (mechanical characteristics) of the recording head 10. In particular, by varying the width of each pulse, the amount of ejected ink can be varied.

The plurality of pulses are combination of an ejection pulse D that causes the recording head to eject an ink droplet, and a cancel pulse C that suppresses change of pressure in the cavity. The ejection pulse appears at the beginning of the drive pulse string, and the cancel pulse C appears at an intermediate portion or end portion of the pulse string.

Figure 7:
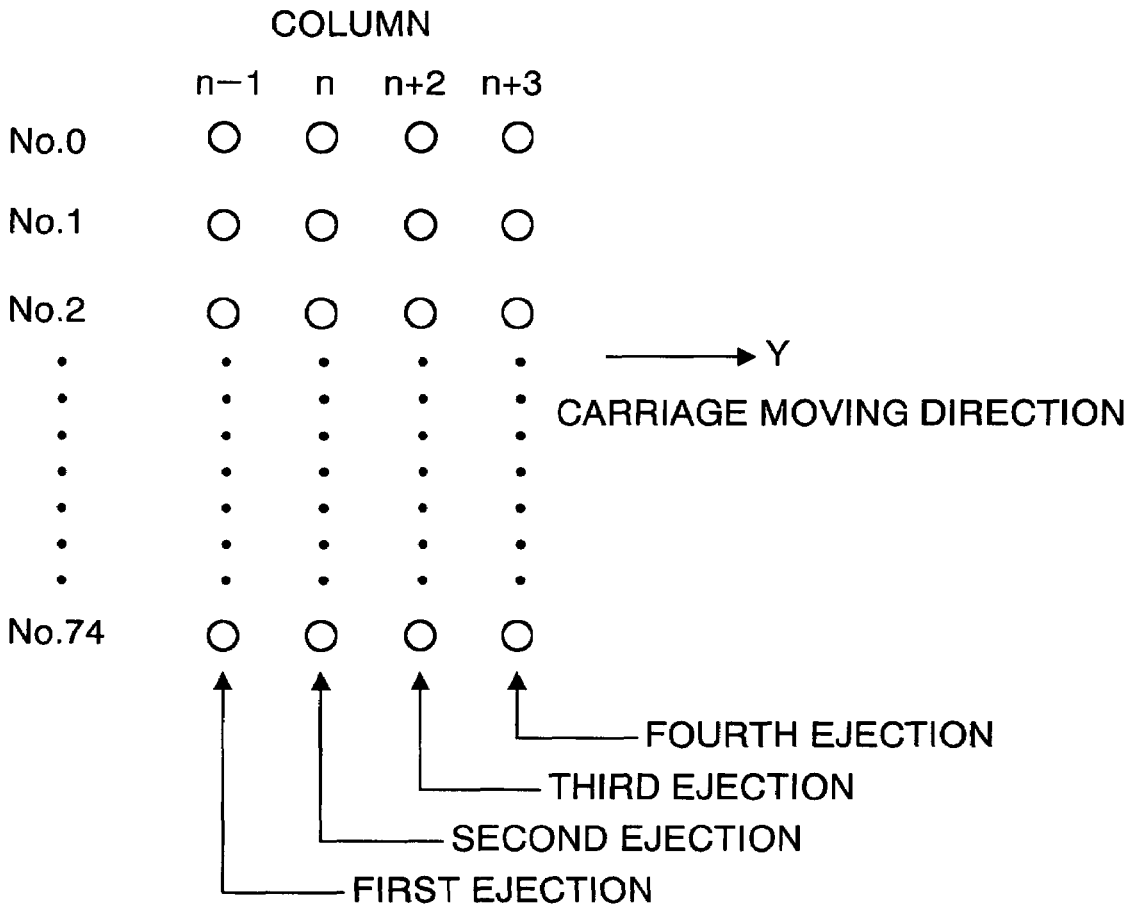
FIG. 7 shows a chart illustrating a relationship between columns and ink dots.

FIG. 7 schematically shows a relationship between the column numbers and ink dots ejected from the nozzle array. As an example, a case where the black ink is ejected by the first nozzle array 24-1 and ink dots (i.e., an image formed by ink drops) are formed will be described.

One nozzle array includes 75 nozzles (nozzle No. 0, nozzle No. 1, nozzle No. 2, . . . , nozzle No. 74), which are aligned in the auxiliary scanning direction (i.e., X direction) on the recording head 10. The carriage 2 mounting the recording head 10 is reciprocally moved in the main scanning direction (i.e., Y direction) which is perpendicular to the auxiliary scanning direction, ink dots are formed two-dimensionally on the recording sheet. In this specification, a position of an ink dot in the main scanning direction (i.e., Y direction) is represented by "column". In FIG. 7, columns on the left-hand side have smaller column numbers, and the right-hand side have larger column numbers. It should be noted that "n" is an arbitrarily determined integer and corresponds to each dot formed, in the main scanning direction, within an effective width of the recording sheet.

In FIG. 7, if a first ink ejection by the nozzles 24 of the first nozzle array 24-1 is performed at an n-th column, and after the recording head 2 is moved rightward by one pitch and a second ink ejection by the nozzle 24 of the first nozzle array 24-1 is performed, the position is regarded as an (n+1)-th column.

In other words, if a current ink ejection by the nozzles 24 of the first nozzle array 24-1 is performed at an n-th column, an ink ejection by the nozzles 24 of the first nozzle array 24-1 at a timing one ejection cycle To earlier was performed at an (n−1)-th column. Similarly, if a current ink ejection by the nozzles 24 of the first nozzle array 24-1 is performed at an n-th column, an ink ejection by the nozzles 24 of the first nozzle array 24-1 at a timing one ejection cycle To later will be performed at an (n+1)-th column.

FIG. 8 shows as aforementioned the drive waveforms.

Waveform #0 represents a reference voltage and it does not include a pulse during the ejection cycle To. That is, during a current ejection cycle (which corresponds to the n-th column), no dot information is output. Thus, no ink droplets are ejected for column n.

Waveform #1 corresponds to a case when a small amount of ink (which will be referred to as a small droplet) is ejected from one nozzle 24 to column n. The waveform #1 includes chronologically output series of the ejection pulse D and cancel pulses C and C.

Waveform #2 corresponds to a case when a middle amount of ink (which will be referred to as a middle droplet) is ejected from one nozzle 24 to column n. The waveform #2 includes chronologically output series of the ejection pulse D and cancel pulse C.

Waveform #3 corresponds to a case when a small amount of ink (which will be referred to as a small droplet for dry) is ejected from one nozzle 24 to column n at a dried environment. The waveform #3 includes chronologically output series of the ejection pulse D and cancel pulse C.

Waveform #4 corresponds to a case when a large amount of ink (which will be referred to as a large droplet) is ejected from one nozzle 24 to column n, and followed by one of the small droplet, small droplet for dry, middle droplet, large droplet and a large end droplet (which will be described later) for the next column (i.e., (n+1)-th column). The waveform #4 includes chronologically output series of the ejection pulses D, D and D and cancel pulse C.

Waveform #5 corresponds to a case when a large amount of ink (which will be referred to as a large end droplet) is ejected from one nozzle 24 to column n, and no ink droplet is ejected for the next column (i.e., (n+1)-th column). The waveform #5 includes chronologically output series of the ejection pulse D, cancel pulse C, ejection pulse D and cancel pulse C.

Waveform #6 is output during the ejection cycle To for (n+1)-th column after waveform #5 is output for n-th column. The waveform #6 includes chronologically output series of the ejection pulse D and cancel pulse C. Since the waveform #5 must be followed by the waveform #6 (i.e., the waveform #6 must be output after the waveform #5), the ink dot formed by outputting the waveforms #5 and #6 will be called a large end droplet.

FIG. 9 shows a table indicating a relationship between dot information for each column and a drive waveform to be selected. In the table, a symbol "-" indicates that the dot information for the column may be present/absent. An indication "present" indicates that the waveform is used when the dot information is present. An indication "absent" indicates that the waveform is used when the dot information is absent.

For example, in a first row (except title row) of the table illustrates that when there is no dot information (i.e., no ink ejection) for a previous column (i.e., (n−1)-th column) and the current column (i.e., n-th column), a designation signal #0, that is, waveform #0 in FIG. 8 is output. In this case, the dot information for the succeeding column (i.e., (n+1)-th column) may be either present of absent.

When the current (i.e., n-th column) dot information represents the small droplet, the designation signal is #1 and waveform #1 is output, regardless of the dot information (including no dot information) of the previous column and the succeeding column.

Similarly, when the current dot information represents the middle droplet or small droplet for dry, the designation signal is #2 or #3, and waveform #2 or #3 is output, regardless of the dot information (including no dot information) of the previous column and the succeeding column.

If the current dot information represents the large droplet and the dot information for the succeeding column (i.e., (n+1)-th column) is present, the designation signal is #4, and waveform #4 is output, regardless of the dot information (including no dot information) of the previous column (i.e., (n−1)-th column).

If the current dot information represents the large droplet and the dot information for the succeeding column (i.e., (n+1)-th column) is absent, the current dot information is the large end droplet, and the designation signal is #5, and waveforms #5 and #6 are output, regardless of the dot information (including no dot information) of the previous column (i.e., (n−1)-th column).

If the dot information (including no dot information) of the previous column (i.e., (n−1)-th column) is the large end droplet, the designation signal for the previous column is #5 and the waveform #5 is output for the previous column. In this case, for the current column (i.e., n-th column), the designation signal is #6, and waveform #6 is output, regardless of the dot information (including no dot information) for the succeeding column (i.e., (n+1)-th column).

As above, when the designation signal is #5, waveform #5 is output for the column of which the dot information indicates the large end droplet, and for the subsequent column, waveform #6 is output. That is, for two subsequent ejection cycles (To×2), waveform #5 and waveform #6 are output subsequently. It should be noted that the although the waveforms #5 and #6 form a single waveform extending two ejection cycles, output thereof is controlled independently (i.e., waveform #5 and waveform #6 are output independently).

The number of the ejection pulses included in waveform #5+waveform #6 is three, which is the same as that of waveform #4. However, the pulses are distributed within an interval of two ejection cycles, ink ejection operation by each ejection pulse D can be made stable in comparison with a case where the same number of ejection pulses are output within a single ejection cycle.

Figure 10:
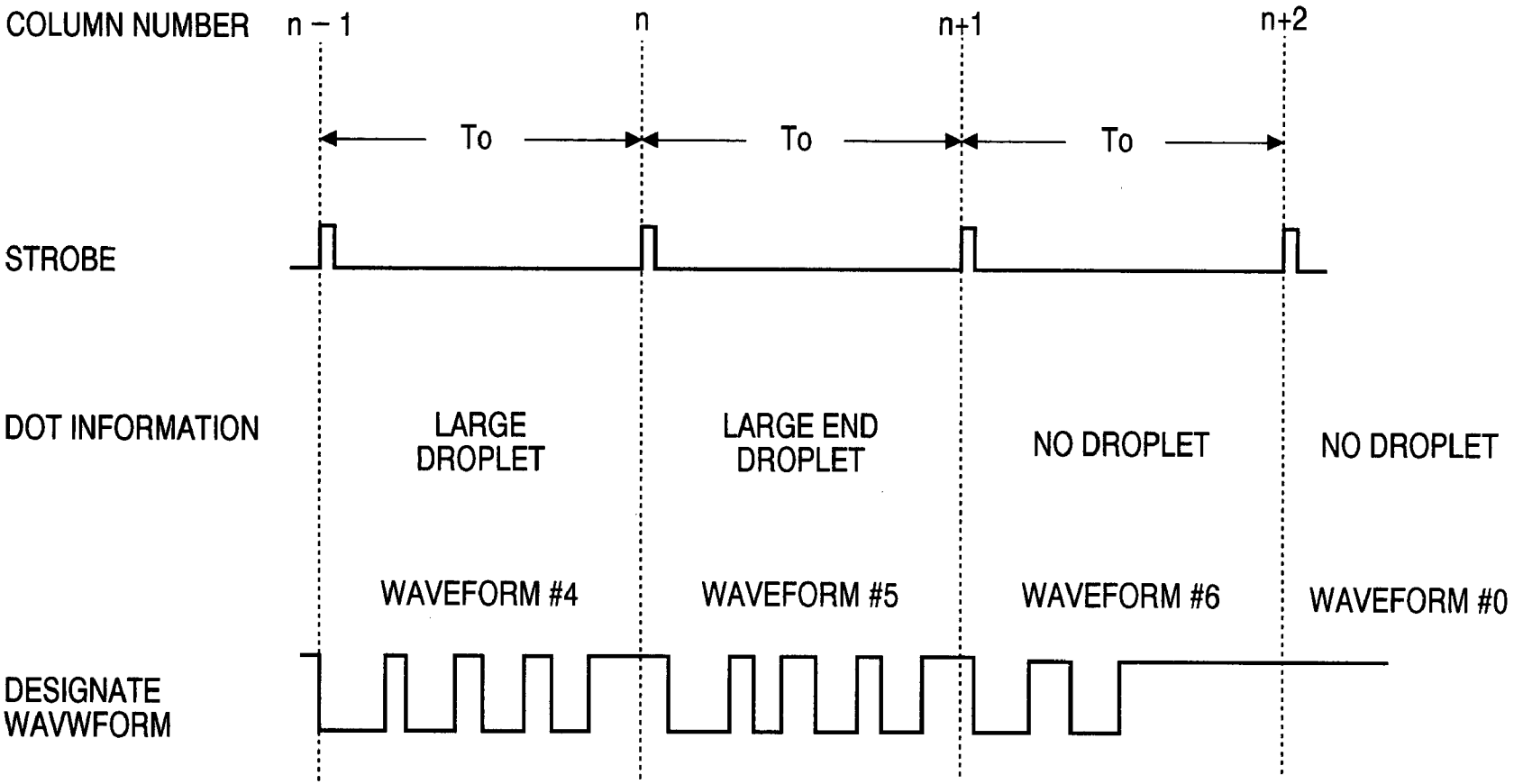
FIG. 10 shows a timing chart illustrating a drive waveform according to the embodiment.

FIG. 10 shows a timing chart illustrating an exemplary combination of drive waveforms according to the embodiment. In this example, the dot information for (n−1)-th column indicates a large droplet, the dot information for n-th column indicates a large end droplet, and the dot information for (n+1)-th and (n+2)-th columns indicates no droplets.

Figure 11:
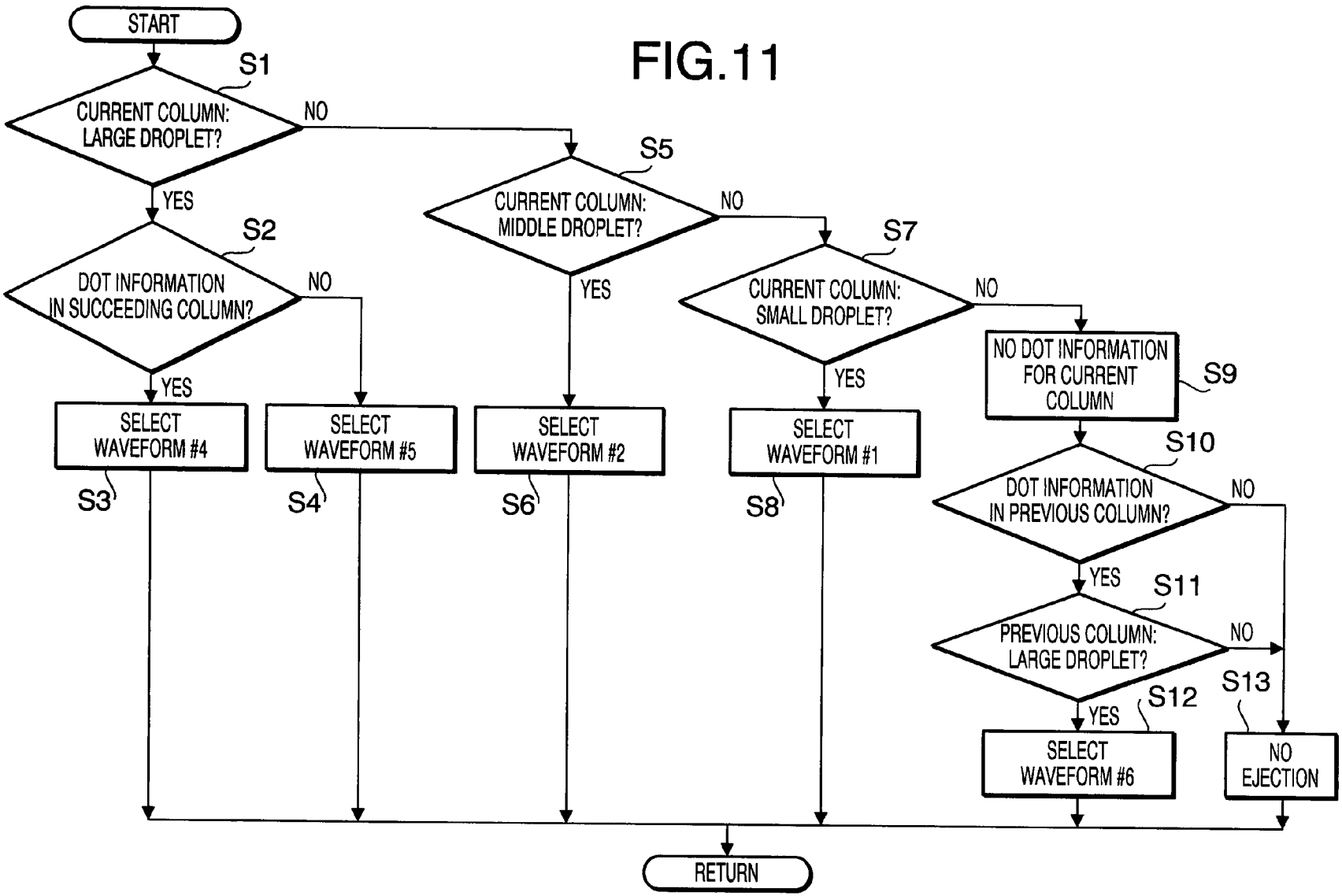
FIG. 11 shows a flowchart illustrating a procedure of selecting a drive waveform in accordance with the dot information.

FIG. 11 shows a flowchart illustrating a procedure of selecting a drive waveform in accordance with the dot information. When the procedure is started, in S1, control judges whether the dot information for current column indicates the large droplet. If the dot information indicates the large droplet (S1: YES), control judges whether there is dot information for the next column (S2). If there is the dot information for the next column (S2: YES), control selects the designation signal #4, that is the waveform #4 and outputs the same (S3). If there is no dot information (S2: NO), control selects the designation signal #5, that is, control selects and outputs waveform #5 (S4). In S1, if control determines that the current dot information (i.e., the dot information for the current column) does not indicate the large droplet (S1: NO), control proceeds to S5.

In S5, control judges whether the dot information for the current column is the middle droplet. If the dot information indicates the middle droplet (S5: YES), control selects the designation signal #2 and outputs the waveform #2. If the dot information does not indicate the middle droplet (S5: NO), control judges whether the dot information for the current column indicates the small droplet (S7).

If control determines that the dot information for the current column indicates the small droplet (S7: YES), control selects the designation signal #1 and output the waveform #1 (S8). If control determines that the dot information for the current column does not indicate the small droplet (S7: NO), control determines that there is no dot information for the current column (S9). That is, no ink droplet is ejected for the current column.

Next, control judges whether there is dot information for the previous column (S10). If control determines that there is dot information (S10: YES), control judges whether the dot information for the previous column indicates the large droplet (S11). If the dot information for the previous column indicates the large droplet (S11: YES), control proceeds to S12 and selects waveform #6. If there is no dot information for the previous column (S10: NO), or the dot information for the previous column dose not indicate the large droplet (S11: NO), control selects the designation signal #0, that is, waveform #0 is selected. Therefore, no ink droplets are ejected (S13).

It should be noted that, instead of the combination of the waveform #5 followed by waveform #6, a combination of the waveform #5 followed by waveform #3 may be used. In such a case, it is not necessary to prepare a particular waveform #6 only for adding the pulses to the waveform #5, and waveform #3 for other purpose can be used. In such a configuration, the number of the waveforms to be stored in the wave generating circuit 68 can be reduced. Further, the number of signal lines connecting the wave generating circuit 68 and the multiplexer 64 can also be reduced. Accordingly, the manufacturing cost can be reduced in comparison with the configuration described above.

In the prior art, if the dot information for the current column indicates the large droplet, and the dot information for the successive column indicates the no droplets, as a drive pulse signal, a long waveform extending in the two successive ejection cycles is selected. The embodiment described above is advantageous in comparison with the prior art, which will be described below.

When the large droplet is to be ejected for the current column and no droplets are ejected for the successive column (i.e., the large end droplet), if, for another nozzle, a drive signal same as that for the current column but shifted by one ejection cycle is output over the two ejection cycles (To×2), the latter half of the pulse signal for the former nozzle disappears, according to the conventional inkjet head. Then, occurrence of the satellite cannot be prevented. According to the embodiment described above, since a combination of two waveforms (#5 and #6) are employed for two ejection cycles, respectively, the waveform does not disappear in the latter ejection cycle. Therefore, it is ensured that the satellite can be prevented successfully.

According to the embodiment, a required storage capacity can be reduced. According to the embodiment, each of the drive pulse signals (i.e., waveforms #1 through #6) includes a pulse string having a plurality of pulses. The drive pulse signals have different pulse strings, and depending on the dot information, the drive pulse signals are appropriately combined (i.e., output successively). According to the conventional art, since a long waveform extending over the two ejection cycles is employed, the number of pulses included in one waveform is relatively large, and therefore, the wave generating circuit is required to have a large storage capacity. According to the embodiment, each drive signal extends within a single ejection cycle, and has less number of pulses. Therefore, the storage capacity of the wave generating circuit 68 can be small, which suppresses the manufacturing cost.

As aforementioned, if waveform #3 is used instead of waveform #6, the number of the waveforms to be stored in the wave generating circuit 68 can be reduced. Then, the structure of the wave generating circuit 68 can be simplified.

Further, the number of signal lines connecting the wave generating circuit 68 and the multiplexer 64 can also be reduced. Accordingly, the manufacturing cost can be reduced in comparison with the configuration described above.

In the above embodiment, the ink jet printer having a movable recording head is described. The invention need not be limited to such an ink jet printer, and is applicable to one provided with a stationary line-head type inkjet head provided with a plurality of nozzles arranged in a main scanning direction.

What is claimed is:

1. An ink ejection device, comprising:

a plurality of nozzles for ejecting ink drops;

a plurality of pressure chambers respectively corresponding to the plurality of nozzles;

an actuator capable of changing capacity of each of the plurality of pressure chambers;

a controlling device that applies a drive pulse signal to the actuator at every predetermined ejection cycle to change the capacity of each pressure chamber to make each nozzle eject an ink droplet, the drive pulse signal being selected in accordance with dot information indicating dots to be formed on a recording medium successively in a direction of a relative movement of the plurality of nozzles with respect to the recording medium, wherein the controlling device includes:

a pulse waveform generating system that generates a plurality of drive pulse signals, each of which lasts within the predetermined ejection cycles;

a signal selecting system that selects one of the plurality of drive pulse signals for each of two successive ejection cycles in accordance with the dot information corresponding to the two successive ejection cycles; and a signal output system the outputs the selected drive pulse signals, wherein, when the dot information for the current ejection cycle and the dot information for the succeeding ejection cycle indicate a first condition where ejection of a maximum amount of an ink drop and no ejection of an ink drop, respectively, the signal selecting system selects two kinds of drive pulse signals for the current ejection cycle and the succeeding ejection cycle, respectively, such that the selected drive pulse signals are different from drive pulse signals for a second condition in which the dot information for the current ejection cycle indicates ejection of a maximum amount of an ink drop and the dot information for the succeeding ejection period indicates ejection of an ink drop, and wherein the signal output system outputs the two kinds of drive pulse signals for the current ejection cycle and the succeeding ejection cycle within the current ejection cycle and in the succeeding ejection cycle, respectively.

2. The ink ejection device, according to claim 1, wherein a signal outputting system outputs the two types of drive pulse signals selected, in the first condition, for the current ejection cycle and the succeeding ejection cycle continuously over the current ejection cycle and the succeeding ejection cycle.

3. The ink ejection device according to claim 1, wherein the drive pulse signal selected, in the first condition, for the current ejection period is selected such that the number of ejection pulses included in the drive signal is less than the number of ejection pulses included in the drive pulse signal selected, in the second condition, for the current ejection period, and wherein the drive pulse signal selected, in the first condition, for the succeeding ejection cycle includes the ejection pulse.

4. The ink ejection device according to claim 1, wherein the drive pulse signal selected, in the first condition, for the succeeding ejection cycle is the same as the drive pulse signal corresponding to the dot information indicating a small ink ejection amount, the small ink ejection amount being an amount less than the maximum amount.

5. The ink ejection device according to claim 1, wherein the drive pulse signal selected, in the first condition, for the succeeding ejection cycle includes a cancel pulse that reduces a change of pressure of the corresponding pressure chamber.

6. The ink ejection device according to claim 1, wherein the amount of ejected ink is varied by varying widths of the pulses included in the drive pulse signal.

* * * * *